US011219238B2

(12) United States Patent
Lisowski et al.

(10) Patent No.: US 11,219,238 B2
(45) Date of Patent: Jan. 11, 2022

(54) METHOD AND APPARATUS FOR CONVEYING ROD-LIKE ARTICLES OF TOBACCO INDUSTRY

(71) Applicant: International Tobacco Machinery Poland Sp. z o. o., Radom (PL)

(72) Inventors: Andrzej Lisowski, Radom (PL); Marcin Mamerski, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 243 days.

(21) Appl. No.: 16/363,306

(22) Filed: Mar. 25, 2019

(65) Prior Publication Data

US 2019/0307162 A1 Oct. 10, 2019

(30) Foreign Application Priority Data

Apr. 4, 2018 (EP) ..... 18165763

(51) Int. Cl.
*A24C 5/32* (2006.01)
*A24D 3/02* (2006.01)

(52) U.S. Cl.
CPC ..... *A24C 5/322* (2013.01); *A24D 3/0287* (2013.01)

(58) Field of Classification Search
CPC ..... A24C 5/32; A24C 5/35; A24C 5/475
See application file for complete search history.

(56) References Cited

U.S. PATENT DOCUMENTS 2,957,285 A 10/1960 Molins
3,010,561 A 11/1961 Ricke
6,101,787 A 8/2000 Brintazzoli
7,743,908 B2 6/2010 Haul
8,118,721 B2 2/2012 Cieslikowski
8,469,181 B2 6/2013 Figarski
9,622,510 B2 4/2017 Mamerski
(Continued)

FOREIGN PATENT DOCUMENTS

EP 2230951 B1 3/2012
EP 3158879 A1 4/2017
(Continued)

OTHER PUBLICATIONS

European search report in application EP18165763.6, dated Oct. 22, 2018.

*Primary Examiner* — Eric Yaary

(74) *Attorney, Agent, or Firm* — Oppedahl Patent Law Firm LLC

(57) ABSTRACT

An apparatus for conveying rod-like articles of the tobacco industry to feed articles to a receiving area of a transferring unit. The transferring unit has lugs moving on a circular path and conveys the articles to the receiving apparatus. The receiving apparatus conveys the articles axially and the lug reduces the speed at least in a part of the path of movement before the area and/or in the area for receiving the articles from the feeding apparatus to the transferring apparatus and increases the speed at least in a part of the path of movement between the area for receiving the articles from the feeding apparatus and the area for transferring the articles to the receiving apparatus. And a method of conveying rod-like articles of the tobacco industry from a receiving area to a transferring area.

17 Claims, 4 Drawing Sheets

(56) References Cited

U.S. PATENT DOCUMENTS

| | | | | |
|---|---|---|---|---|
| 2007/0117700 | A1 | 5/2007 | Ishii | |
| 2009/0145449 | A1 | 6/2009 | Cieslikowski et al. | |
| 2012/0157278 | A1* | 6/2012 | Cieslikowski ..... | A24D 3/0287 493/45 |
| 2017/0113879 | A1 | 4/2017 | Stanikowski et al. | |

FOREIGN PATENT DOCUMENTS

| | | | |
|---|---|---|---|
| WO | WO03024898 | A2 | 3/2003 |
| WO | 2016020792 | A1 | 2/2016 |

* cited by examiner

METHOD AND APPARATUS FOR CONVEYING ROD-LIKE ARTICLES OF TOBACCO INDUSTRY

The object of the invention is a method and an apparatus for conveying rod-like articles of the tobacco industry.

In the tobacco industry machines, various kinds of rod-like articles such as non-filter cigarettes, filter cigarettes, cigarillos, filter rods made of one kind of material, multi-segment filter rods, cigars etc. are manufactured. The semi-finished products manufactured at individual production stages are also referred to as rod-like articles. The rod-like articles may be transferred in a mass flow in which the reciprocal position of the articles being transferred is random and variable, however, a part of the machines requires transferring of rod-like articles in streams of individual articles in which the position of neighbouring articles relative to one another is defined. It is possible to transfer the rod-like articles successively one after another so that the axes of the rod-like articles are parallel to the transferring direction, which means that the articles are transferred axially. It is possible to transfer the articles one after another so that the axes of the articles are situated transversely to the conveying direction, the axes of the articles being situated parallel to one another.

Multi-segment filter rods are an example of a rod-like article which is composed of a plurality of rod-like articles. The multi-segment filter rods consist of segments made of various kinds of filter materials. Before manufacturing multi-segment rods, the filter rods containing a filter material of one kind are cut into a plurality of short filter segments. The filter segments made of different materials are placed in an appropriate order maintaining defined distances between the segments in order to ultimately manufacture multi-segment rods in successive operations, whereas in a finished rod the segments may touch each other or there may be distances left between the segments. An apparatus for the manufacture of multi-segment filter rods is known from the patent EP2230951B1, whereas in that apparatus several streams of rod-like articles with different configurations may be indicated. The rods made of a filter material of one kind are cut into segments which are conveyed in the form of a first stream in which the segments move axially one after another. The segments are fed one by one from the stream by means of a separating cam to a transferring apparatus comprising a transferring wheel provided with lugs which transfers the segments onto a belt conveyor. A segment stream forming unit together with the separating cam designed to separate individual segments constitute a feeding apparatus designed to feed the segments to the transferring apparatus, whereas the configuration of the stream from which the separating cam pulls out the segments, one at a time, is such that the segments move coaxially one after another and remain in contact with one another. The segments are transferred downwards by means of a transferring disc with lugs onto the belt conveyor which, in the segment receiving area, is U-shaped in cross-section. The belt conveyor constitutes a receiving apparatus on which a second stream of segments with a configuration different from the first stream is formed. The stream configuration on the belt conveyor is such that the segments move coaxially at distances. The patent EP2230951B1 has disclosed a transferring disc of a transferring apparatus on which the lugs are arranged uniformly and are used to place the segments at equal distances on the belt conveyor.

The segments are transferred from the first segment stream uniformly to a place from which they are taken by a lug of the transferring disc. A problem occurs in the case of an increase in machine efficiency when there is a need to increase the movement velocity of the segments on the belt conveyor. The transferring disc is designed in such a way that all lugs have the same velocity, so with increasing receiving speed also the speed with which the segments are hit and taken after being fed by the separating cam is increasing. The increasing speed with which a segment is hit may cause damage to the segments, which reduces the quality of manufactured segments. High accelerations may cause shifting of segment components or slipping out of segment contents from the wrapping material. Furthermore, in the case of feeding of very short segments, a momentary high acceleration may cause an uncontrolled movement of such short segment. As a result, short segments may be transferred and placed onto the belt conveyor in an uncontrolled position, in consequence of which a defective rod will be manufactured. The control system should detect such rod and it should be rejected from the production. However, a part of the rods with turned segments is not detected and defective filter tips made of them are attached to cigarettes. On the other hand, any deformations of individual segments may cause the deformations of complete multi-segment rods. Such defective cigarettes may get to customers.

This invention solves the problem of developing a conveying apparatus to convey rod-like articles which will eliminate the risk of manufacture of defective rods.

The object of the invention is an apparatus for conveying rod-like articles of the tobacco industry comprising a feeding apparatus adapted to feed rod-like article to a receiving area of a transferring unit, the transferring unit having lugs moving on a circular path, adapted to convey the rod-like article from the feeding apparatus to a receiving apparatus, the lug being attached rotatably relative to a rotatable disc and actuated by means of a drive mechanism, the path of movement of the lug passing through the area for receiving the rod-like article from the feeding apparatus and an area for transferring the rod-like article to the receiving apparatus, and the receiving apparatus adapted to convey the rod-like articles axially one after another. The apparatus according to the invention is characterised in that the drive mechanism is adapted so that the lug reduces the speed at least in a part of the path of movement before the area and/or in the area for receiving the rod-like article from the feeding apparatus to the transferring apparatus, and increases the speed at least in a part of the path of movement between the area for receiving the rod-like article from the feeding apparatus and the area for transferring the rod-like article to the receiving apparatus.

The apparatus according to the invention is further characterised in that the drive mechanism is additionally adapted so that the lug increases the speed at least in a part of the path of movement between the area for transferring the rod-like article to the receiving apparatus and the area for receiving the rod-like article from the feeding apparatus.

The apparatus according to the invention is further characterised in that the drive mechanism is provided with a cam and a double-arm lever attached rotatably relative to the rotatable disc. The lug is attached to the double-arm lever, to its longer arm, and the shorter arm of the double-arm lever is provided with a roller which rolls on the cam of the drive mechanism. The longer arm of the double-arm lever has a considerably greater length than the shorter arm of the double-arm lever.

The apparatus according to the invention is further characterised in that the proportion of the length of the longer arm of the double-arm lever to the shorter arm of the double-arm lever is greater than 2:1, preferably greater than 3:1.

The apparatus according to the invention is further characterised in that the drive mechanism is provided with electric drive with a linear electromagnetic motor whose track has an oval shape, and drive carriages moving along the track. The lug is attached to the drive carriage. The electric drive is adapted to actuate the drive carriage with a variable speed.

The apparatus according to the invention is further characterised in that the drive mechanism is provided with a gear wheel and a mating planet gear attached to the rotatable arm, with the lug being attached to the gear wheel. The arm and the gear wheel have independent drives.

The apparatus according to the invention is further characterised in that the drive mechanism is provided with a flexible bracket and an arm provided with support elements comprising the flexible bracket. The lug is attached to the flexible bracket. The flexible bracket and the arm have independent drives.

The apparatus according to the invention is further characterised in that the feeding apparatus is adapted to feed the rod-like article transversely to the axis of the rod-like article.

The apparatus according to the invention is further characterised in that the feeding apparatus is provided with a separating cam designed to feed the rod-like article.

The apparatus according to the invention is further characterised in that the feeding apparatus is adapted to feed the rod-like article tangentially to the circular path of movement of the lug (15') on the transferring apparatus.

The apparatus according to the invention is further characterised in that the receiving apparatus is a belt conveyor.

The apparatus according to the invention is further characterised in that the receiving apparatus is a conveying disc with lugs.

The apparatus according to the invention is further characterised in that the receiving apparatus is adapted to convey the rod-like articles at equal distances.

The object of the invention is also a method of conveying a rod-like article of the tobacco industry from an apparatus feeding the rod-like article through an apparatus transferring the rod-like article to a receiving apparatus in which the rod-like article is fed from the feeding apparatus to the transferring apparatus, the rod-like article is transferred on a circular path of movement by means of the transferring apparatus provided with the lugs, the rod-like article is transferred from the transferring apparatus to the receiving apparatus adapted to convey the rod-like articles axially one after another. The method according to the invention is characterised in that while conveying the rod-like article in the transferring apparatus the speed of the rod-like article is increased between the area for receiving the rod-like article from the feeding apparatus and the area for transferring the rod-like article to the receiving apparatus.

The method according to the invention is further characterised in that the rod-like article is fed to the transferring disc transversely to the axis of the rod-like article.

The method according to the invention is further characterised in that the rod-like article is fed to the transferring disc tangentially to the axis of the rod-like article.

The method according to the invention is further characterised in that the rod-like articles are conveyed at equal distances in the receiving apparatus.

An advantage of the invention is the control of the speed of the lugs as a result of which a high speed gradient during the rod-like article transferring operations in the article transferring areas in the conveying apparatus is avoided. It allows avoiding the destruction of the rod-like articles of the tobacco industry which are fragile and vulnerable to mechanical damage occurring during a stroke.

The object of the invention was shown in detail in a preferred embodiment in a drawing in which.

Figure 1:
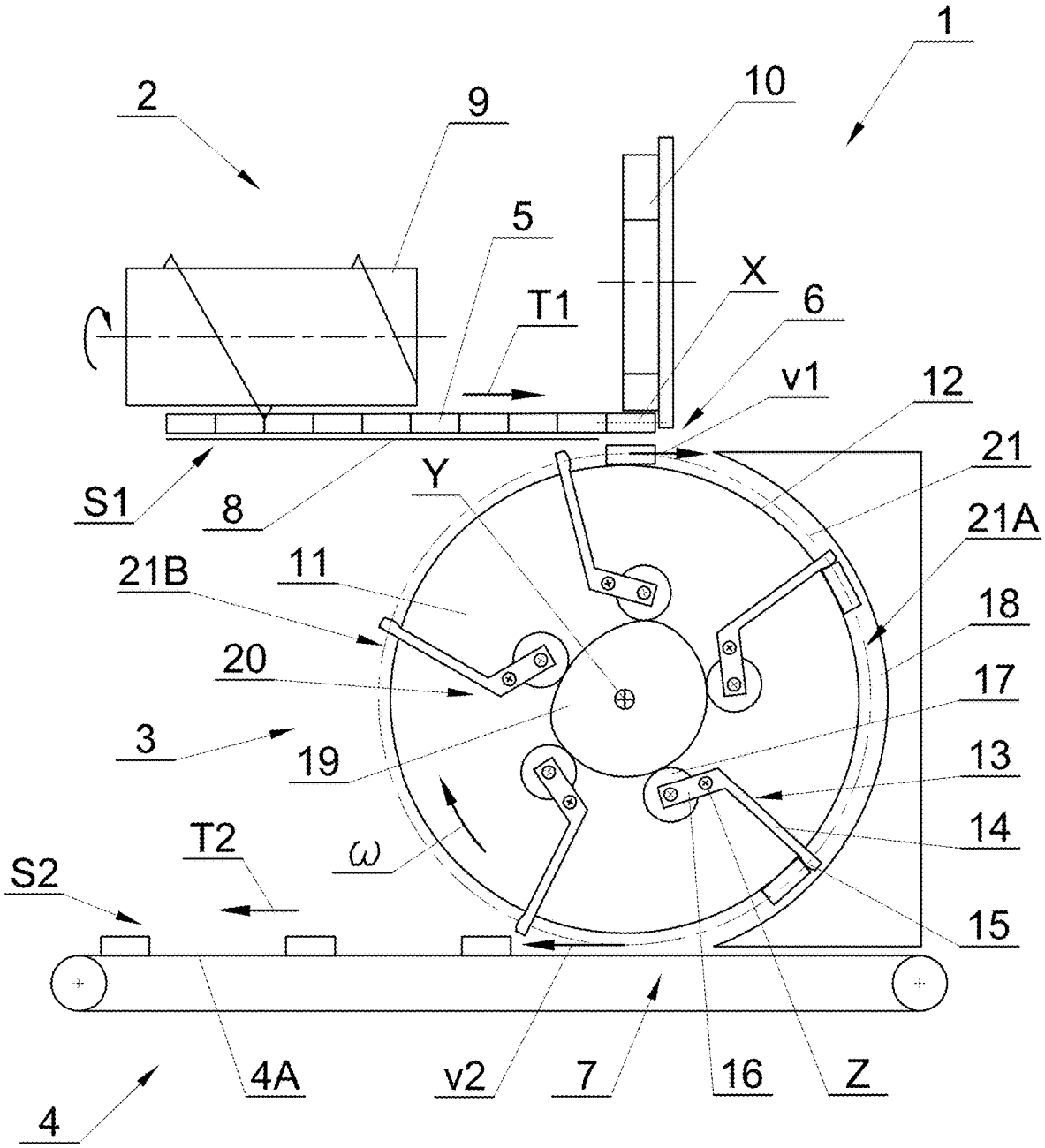
FIG. 1 shows a transferring apparatus in a first embodiment.

FIG. 1 shows a conveying apparatus 1 comprising a feeding apparatus 2, a transferring apparatus 3 and a receiving apparatus 4. The feeding apparatus 2 is adapted to feed the rod-like article 5 with the longitudinal axis X to a receiving area 6 of the transferring apparatus 3 which conveys the rod-like article 5 to a transferring area 7. Furthermore, the receiving apparatus 4 is adapted to receive the rod-like article 5 from the transferring area 7, axially one after another. In the embodiment shown, the feeding apparatus 2 comprises a channel 8 along which the rod-like articles 5 move axially one after another in the direction T1 in a stream S1, whereas the movement of the rod-like articles 5 is accomplished by means of a spiral drum 9. A separating cam 10 is used to push the first rod-like article 5 into the receiving area 6, whereas the pushing and the feeding of an individual rod-like article by the feeding apparatus 2 takes place transversely to the axis X of the rod-like article 5. The feeding apparatus 2 is adapted to feed the rod-like article 5 so that the rod-like article is placed tangentially to the circular movement of a lug 15 on the transferring apparatus 3. The rod-like article 5 may be fed transversely to the axis X with a zero velocity in the tangential direction to the path of movement of the rod-like article 5 on the transferring apparatus 3. The rod-like article 5 may be fed with a certain velocity v1 in the tangential direction to the path of movement on the transferring apparatus 3, whereas the velocity v1 in the tangential direction constitutes the initial velocity of the rod-like article 5 for the movement on the path of movement, and its value stands at between 0 and 4 m/s. The feeding apparatus 2 may also have the form of a vertical channel in which the rod-like articles 5 which are fed one by one to the receiving area 6 are collected; in such case the initial velocity amounts to zero. In this embodiment, the receiving apparatus 4 is a belt conveyor provided with a belt 4A which conveys the rod-like articles 5 in the direction T2 in a stream S2 at equal distances.

Furthermore, the receiving apparatus 4 may have the form of a conveying disc with lugs. The velocity v2 with which the rod-like article 5 moves in the transferring area 7 and on the receiving apparatus 4 is several times greater than the initial velocity v1, whereas the value of the velocity v2 stands at between 8 and 12 m/s. For example, when conveying the rod-like article 5 the velocity of the rod-like article 5 is increased from the velocity v1 equal to 2 m/s to the velocity v2 equal to 10 m/s.

The transferring apparatus 3 is provided with a rotatable disc 11 with the axis of rotation Y having the circumferential surface 12, whereas the disc 11 rotates with a constant speed ω. The transferring apparatus 3 is provided with the lugs 15, rotatably attached to the disc 11 by means of a double-arm lever 13 and actuated by means of a drive mechanism 20. The double-arm lever 13 is rotatably attached on the axis Z, whereas the lug 15 is attached to the double-arm lever 13 on its longer arm 14, and the shorter arm 16 of the double-arm lever 13 is provided with a rotatably attached roller 17 rolling on the cam 19 of the drive mechanism 20. The lug 15 is used to convey the rod-like article 5 around or on the circumferential surface 12 in a conveying channel 18. The roller 17 mates with the cam 19 attached fixedly, centrally to the rotatable disc 11. The arms 14 and 16 of the lever 13 may be equal, however, preferably the arm 14 carrying the lug 15 is longer than the arm 16 carrying the roller 17, preferably 2 times longer, more preferably more than 3 times longer. The cam 19 together with the roller 17 and the arms 14 and 16 of the lever 13 constitute the drive mechanism 20 designed to shift the lugs 15 relative to the surface of the rotatable disc 11.

The lug 15 moves on the movement path 21 and is adapted to convey the rod-like article 5 in the conveying channel 18, from the feeding apparatus 2 to the receiving apparatus 4. The movement path 21 has two parts, the first part 21A of the path 21 runs from the rod-like article receiving area 6 to the rod-like article transferring area 7, the second part 21B of the movement path 21 runs from the rod-like article transferring area 7 to the rod-like article receiving area 6. In the receiving area 6, the rod-like article 5 begins its movement in the part 21A of the path 21, while in the transferring area 7 the rod-like article 5 ends its movement in the part 21A, with the drive mechanism being adapted so that the lug 15 reduces the speed at least in the part of the movement path 21 before the receiving area 6, i.e. still in the part 21B and/or in the area 6 for receiving the rod-like article 5 from the feeding apparatus 2 to the transferring apparatus 3, and increases the speed at least in the part 21A of the movement path 21, between the area 6 for receiving the rod-like article from the feeding apparatus 2 and the area 7 for transferring the rod-like article 5 to the receiving apparatus 4. In order to reduce the accelerations acting on the rod-like article 5, the cam 19 is designed so that in the receiving area 6 the lug 15 moves with a minimum speed, while a reduction of the speed of the lug 15 takes place at least before the receiving area 6, precisely before the moment of commencement of the movement by the rod-like article 5 in the receiving area 6. After the commencement of the movement by the rod-like article 5 in the part 21A of the path 21 the velocity of that article increases. The transferring velocity, i.e. the velocity required in the transferring area 7, may be achieved only in a certain fragment of the part 21A. Then, after being fed, the rod-like article 5 initially increases its velocity to the maximum velocity required in the receiving apparatus 4, and then moves further witch such velocity up to the transferring area 7. The increase of the velocity of the rod-like article 5 to the transferring velocity may take place in the entire part 21A. Then, after being fed, the rod-like article 5 increases its velocity at a uniform rate on the entire way from the receiving area 6 to the transferring area 7. The double-arm lever 13 is attached rotatably relative to the disc 11. In order to increase the speed of the lug 15, the cam 19 forces a clockwise rotation of the lever 13 relative to the disc 11. Once the lug 15 has passed through the transferring area 7, the lug 15 moves in the part 21B, whereas at the end of the part 21B the speed of the lug 15 must be reduced to the minimum. The cam 19 may be designed so that the speed of the lug 15 is reduced continuously. The drive mechanism 20 may be additionally adapted to increase the speed of the lug 15, at least in the part 21B of the path 21, between the area 7 for transferring the rod-like article 4 to the receiving apparatus 4 and the area 6 for receiving the rod-like article 5 from the feeding apparatus 2, i.e. the cam 19 may be also designed so that initially the speed of the lug 15 increases in the part 21B, and then decreases to the minimum in the receiving area 6. In order to reduce the speed of thee lug 15, the cam 19 forces an anticlockwise rotation of the lever 13 relative to the disc 11.

Figure 2:
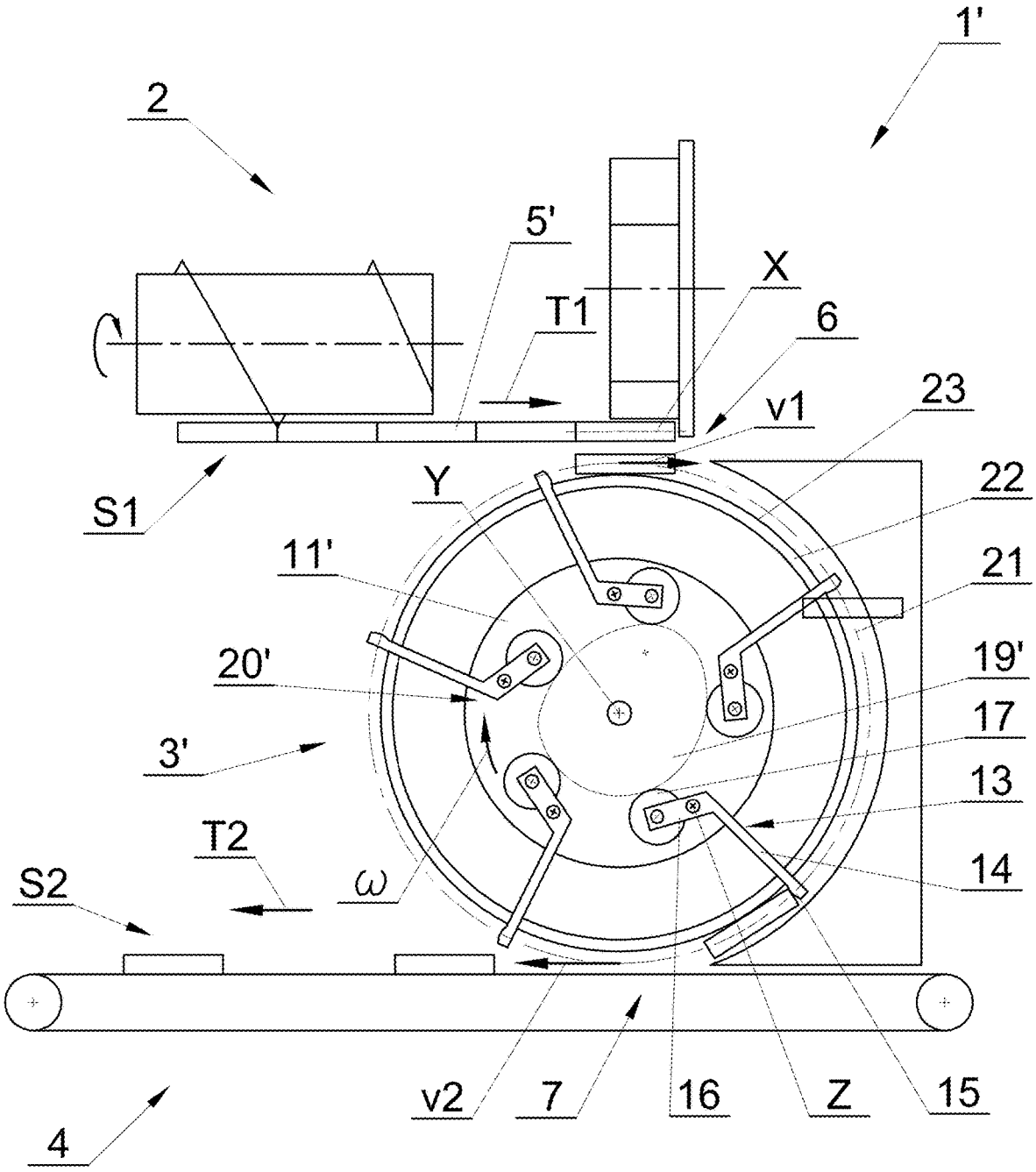
FIG. 2 shows a second embodiment of the transferring apparatus according to the invention.

FIG. 2 shows a second embodiment of the conveying apparatus 1', similar to the first embodiment, where the rod-like articles 5' with a greater length are conveyed. According to this embodiment, the transferring apparatus 3' is provided with the lugs 15 moving on the path 21. The levers 13 mating with the cam 19' are attached rotatably relatively to the disc 11' with a smaller diameter than in the first embodiment, the disc 11' rotates with a constant speed ω. The shape of the cam 19' was adapted to the greater length of the rod-like article 5', it was taken into consideration that the speed of the lug needs to be reduced earlier in the part 21B in order to achieve the minimum speed earlier. In the second embodiment, there was used a stationary guide 22 having a circumferential surface 23 on which the rod-like articles 5' move.

Figure 3:
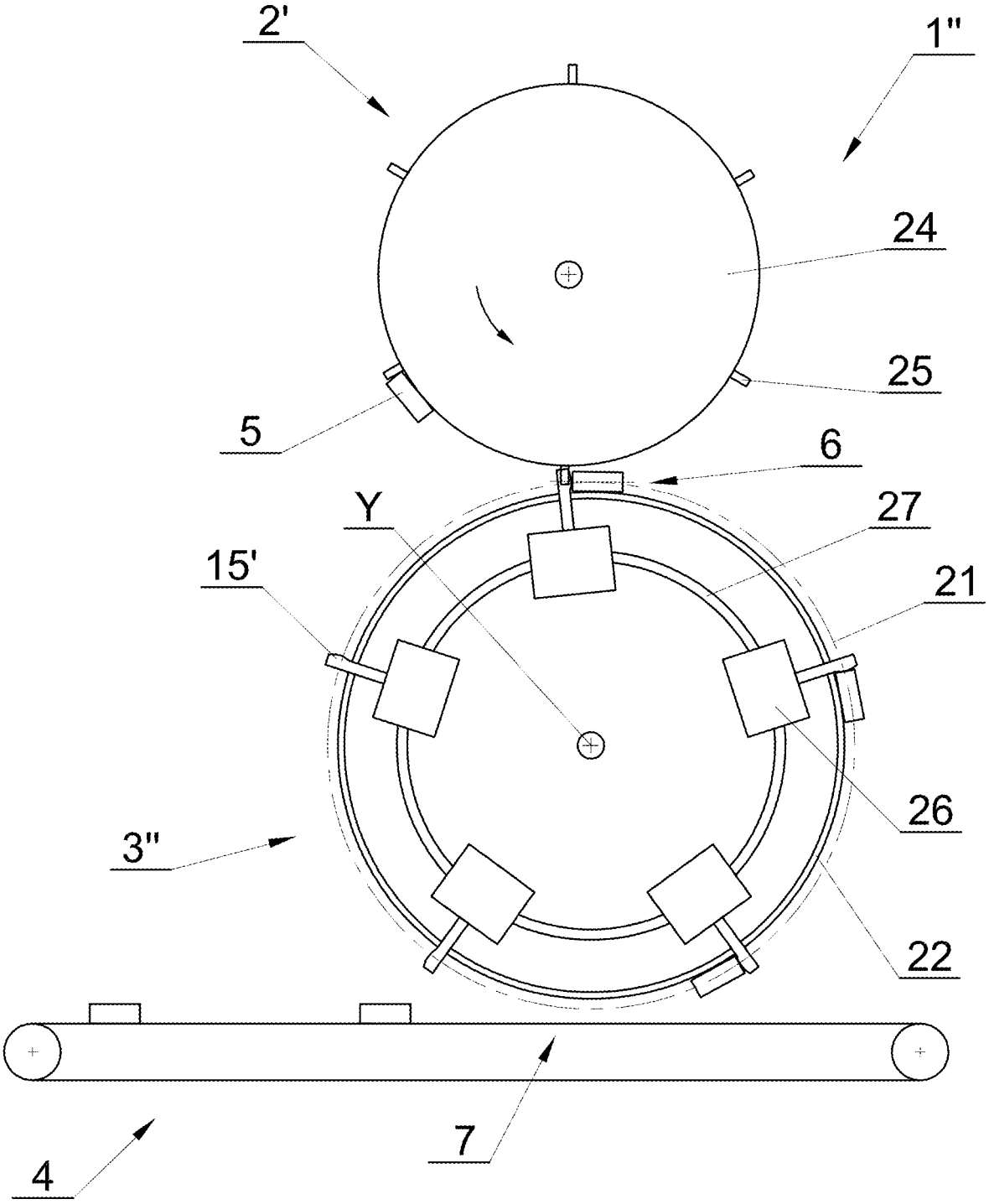
FIG. 3 shows a third embodiment of the transferring apparatus according to the invention.

In the third embodiment of the conveying apparatus 1" shown in FIG. 3, the drive mechanism is provided with an electric drive with a linear electromagnetic motor. According to this embodiment, the feeding apparatus 2' has the form of a rotatable disc 24 provided with the lugs 25 fixedly attached to the disc 24. The feeding apparatus feeds the rod-like articles 5 axially and tangentially to the movement path of the rod-like article 5 in the receiving area 6 on the transferring apparatus 3". The transferring apparatus 3" is provided with the lugs 15'. The lugs 15' are attached to drive carriages 26 which have an electromagnetic drive and move on a track 27 with an oval shape, on a stationary guide 22 in such a way as if they were attached rotatably relative to the axis Y. Besides, the electric drive is adapted to actuate the drive carriage 26 with a variable speed as described for the first and second embodiments. The acceleration of the carriage, maintaining the speed of the carriage at a constant level and the deceleration of the carriage take place by means of an electromagnetic drive controller.

Figure 4:
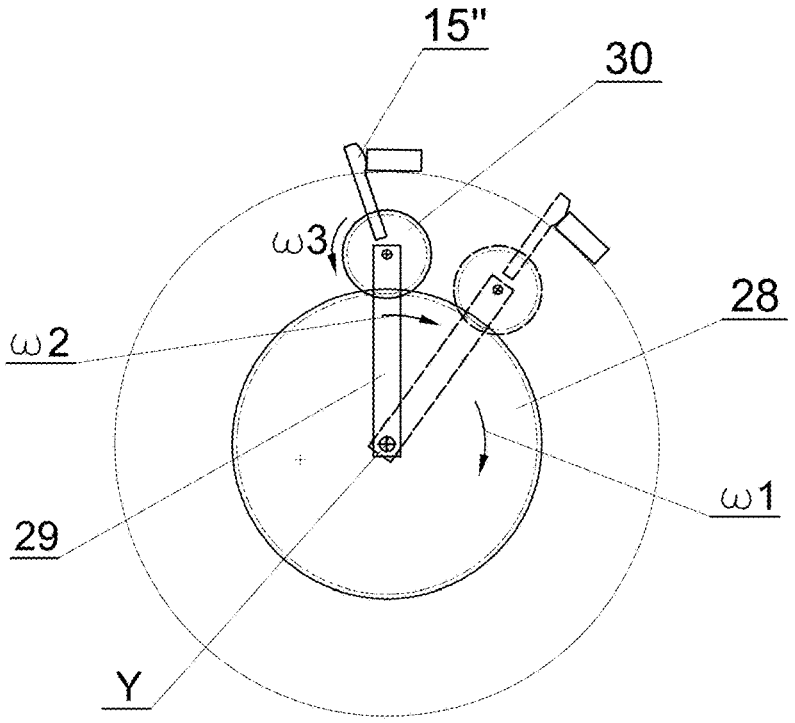
FIG. 4 shows a fourth embodiment of the transferring apparatus according to the invention.

FIG. 4 shows an embodiment of an individual lug 15" which may be used in the conveying apparatus. According to this embodiment, the drive mechanism is provided with a gear wheel 28, rotatably attached on the axis Y. A planet gear 30 which is geared and is mating with the gear wheel 28 is attached to the rotatable arm 29 also on the axis Y. The gear wheel 28 moving with the speed ω1 has a drive which is independent of the drive of the arm 29 moving with the speed ω2 and carrying the planet gear 30 (the drives of the gears were not shown). The lug 15" is attached to the planet gear 30. The speed of the lug 15" is controlled by changing the angular speeds ω1 and ω2. When the lug 15" moves before the receiving area 6, the speed of the lug 15" is reduced either by reducing the speed ω2 or by increasing the speed ω1, in each case the lug 15" will turn with the speed ω3 so that the lug 15" will reduce its speed (in the drawing, it will deviate to the left). In order to accelerate the lug 15", a reverse change of the speeds ω1 and ω2 needs to be made.

Figure 5:
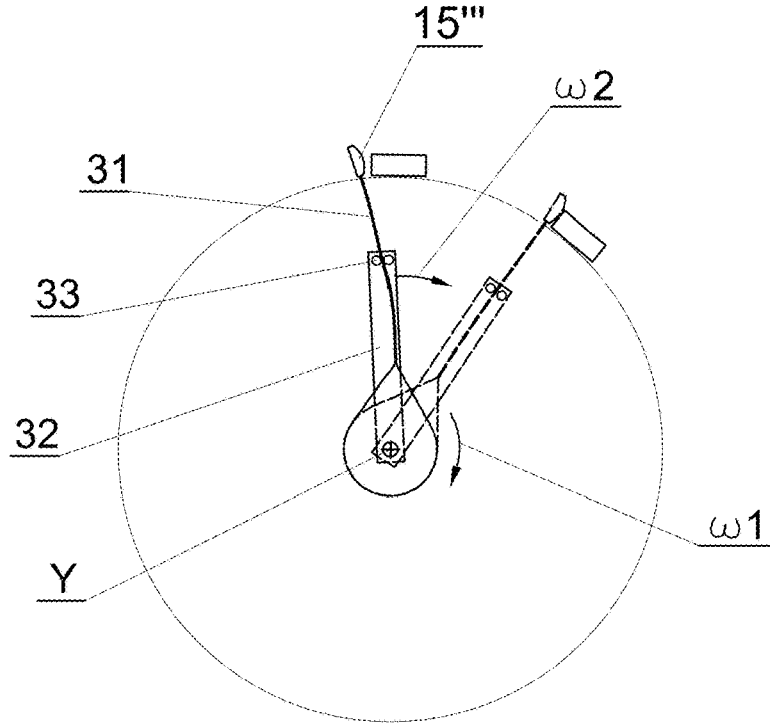
FIG. 5 shows a fifth embodiment of the transferring apparatus according to the invention.

Another embodiment of an individual lug 15''' was shown in FIG. 5. According to this embodiment, the drive mechanism is provided with a flexible bracket 31 of the lug 15''', rotatably attached on the axis Y and an arm 32 provided with support elements 33 comprising the flexible bracket 31. The flexible bracket 31 has, for example, the form of a flat spring. Also on the axis Y, there is attached an arm 32 having support elements 33 which comprise, on both sides, the flexible bracket 31. The flexible bracket 31 moving with the speed ω1 has a drive which is independent of the drive of the arm 32 moving with the speed ω2 (the drives were not shown). The speed of the lug 15''' is controlled by changing the angular speeds ω1 and ω2. When the lug 15''' moves before the receiving area 6, the speed of the lug 15''' is reduced either by reducing the speed ω2 or by increasing the speed ω1, in each case the lug 15''' will deviate so that the lug 15''' will reduce its speed (in the drawing, it will deviate to the left). In order to accelerate the lug 15'',' a reverse change of the speeds ω1 and ω2 needs to be made.

The object of the invention is also a method for conveying the rod-like articles 5, 5' from the rod-like article feeding apparatus 2, 2' through the rod-like article transferring apparatus 3, 3', 3'' to the receiving apparatus 4. In the embodiment of the method according to the invention the rod-like article is fed from the feeding apparatus 2, 2' to the transferring apparatus 3, 3', 3'', the rod-like article is transferred on a circular path of movement by means of the transferring apparatus 3, 3', 3'' provided with the lugs 15. Then the rod-like article is transferred from the transferring apparatus 3, 3', 3'' to the receiving apparatus 4 adapted to convey the rod-like articles one after another. While conveying the rod-like article in the transferring apparatus 3, 3', 3'' the speed of the rod-like article is increased between the area 6 for receiving the rod-like article from the feeding apparatus 2, 2' and the area 7 for transferring the rod-like article to the receiving apparatus 4.

In one of the embodiments of the method according to the invention the rod-like article is fed to the transferring disc transversely to the axis of the rod-like article. Alternatively, the rod-like article is fed to the transferring disc tangentially to the axis of the rod-like article. Regardless of the above, in the preferred embodiment of the method according to the invention the rod-like articles are conveyed at equal distances on the receiving apparatus 4.

The invention claimed is:

1. Apparatus (1, 1', 1'') for conveying rod-like articles of the tobacco industry comprising a feeding apparatus (2, 2') adapted to feed rod-like article (5, 5') to a receiving area (6) of a transferring unit (3, 3', 3''), the transferring unit (3, 3', 3'') having lugs (15, 15') moving on a circular path, adapted to convey a rod-like article (5, 5') from the feeding apparatus (2, 2') to the receiving apparatus (4), the lug (15, 15') being attached rotatably relative to a rotatable disc (11, 11') and actuated by means of a drive mechanism (20, 20'), the path of movement (21) of the lug (15, 15') passing through the area (6) for receiving the rod-like article (5, 5') from the feeding apparatus (2, 2') and an area (7) for transferring the rod-like article (5, 5') to the receiving apparatus (4), and the receiving apparatus (4) adapted to convey the rod-like articles (5, 5') axially one after another, characterised in that the drive mechanism (20, 20') is adapted so that the lug (15, 15') reduces the speed at least in a part (21B) of the path of movement (21) before the area (6) and/or in the area (6) for receiving the rod-like article (5, 5') from the feeding apparatus (2, 2') to the transferring apparatus (3, 3') and increases the speed at least in a part (21A) of the path of movement (21) between the area (6) for receiving the rod-like article (5, 5') from the feeding apparatus (2, 2') and the area (7) for transferring the rod-like article (5, 5') to the receiving apparatus (4).

2. Apparatus as in claim 1 characterised in that the drive mechanism (20, 20') is additionally adapted so that the lug (15, 15') increases the speed at least in a part (21B) of the path of movement (21) between the area (7) for transferring the rod-like article (5, 5') to the receiving apparatus (4) and the area (6) for receiving the rod-like article (5, 5') from the feeding apparatus (2, 2').

3. Apparatus as in claim 1 characterised in that the drive mechanism (20, 20') is provided with a cam (19, 19') and a double-arm lever (13) attached rotatably relative to the rotatable disc (11,11'), in addition, the lug (15, 15') is attached to the double-arm lever (13), to its longer arm (14), and the shorter arm (16) of the double-arm lever (13) is provided with a roller (17) which rolls on the cam (19, 19') of the drive mechanism (20, 20'), whereas the longer arm (14) of the double-arm lever (13) has a considerably greater length than the shorter arm (16) of the double-arm lever (13).

4. Apparatus as in claim 3 characterised in that the proportion of the length of the longer arm (14) of the double-arm lever (13) to the shorter arm (16) of the double-arm lever (13) is greater than 2:1, preferably greater than 3:1.

5. Apparatus as in claim 1 characterised in that the drive mechanism is provided with an electric drive with a linear electromagnetic motor whose track (27) has an oval shape, and drive carriages (26) which move along the track (27), in addition, the lug (15') is attached to the drive carriage (26), whereas the electric drive is adapted to actuate the drive carriage (26) with a variable speed.

6. Apparatus as in claim 1 characterised in that the drive mechanism (20, 20') is provided with a gear wheel (28) and a mating planet gear (30) attached to the rotatable arm (29), the lug (15'') being attached to the gear wheel (30), the arm (29) and the gear wheel (28) having independent drives.

7. Apparatus as in claim 1 characterised in that the drive mechanism is provided with a flexible bracket (31) and an arm (32) provided with support elements (33) comprising the flexible bracket (31), whereas the lug (15'') is attached to the flexible bracket (31), and the flexible bracket (31) and the arm (32) have independent drives.

8. Apparatus as in claim 1 characterised in that the feeding apparatus (2) is adapted to feed the rod-like article (5, 5') transversely to the axis (X) of the rod-like article (5, 5').

9. Apparatus as in claim 8 characterised in that the feeding apparatus (2) is provided with a separating cam (10) designed to feed the rod-like article (5, 5').

10. Apparatus as in claim 1 characterised in that the feeding apparatus (2') is adapted to feed the rod-like article (5, 5') tangentially to the circular path of movement (21) of the lug (15') on the transferring apparatus (3'').

11. Apparatus as in claim 1 characterised in that the receiving apparatus is a belt conveyor.

12. Apparatus as in claim 1 characterised in that the receiving apparatus is a conveying disc (24) with lugs (25).

13. Apparatus as in claim 1 characterised in that the receiving apparatus (4) is adapted to convey the rod-like articles at equal distances.

14. Method of conveying rod-like article of the tobacco industry from a rod-like article feeding apparatus through an apparatus transferring a rod-like article to a receiving apparatus in which the rod-like article is fed from the feeding apparatus to the transferring apparatus, the rod-like article is transferred on a circular path of movement by means of the transferring apparatus provided with lugs, the lug being attached rotatably relative to a rotatable disc, the rod-like article is transferred from the transferring apparatus to the receiving apparatus adapted to convey the rod-like articles axially one after another, characterised in that while conveying the rod-like article in the transferring apparatus the speed of the rod-like article is reduced before the area and/or in the area for receiving the rod-like article from the feeding apparatus to the transferring apparatus, and while conveying the rod-like article in the transferring apparatus the speed of the rod-like article is increased between an area for receiving a rod-like article from the feeding apparatus and the area for transferring the rod-like article to the receiving apparatus and in that increase or reduction of the speed of the rod-like article is made by the lug actuated by a drive mechanism.

15. Method as in claim 14 characterised in that the rod-like article is fed to the transferring disc transversely to the axis of the rod-like article.

16. Method as in claim 14 characterised in that the rod-like article is fed to the transferring disc tangentially to the axis of the rod-like article.

17. Method as in claim 14 characterised in that the rod-like articles are conveyed at equal distances in the receiving apparatus.

* * * * *